US007448719B1

(12) United States Patent
Newell

(10) Patent No.: US 7,448,719 B1
(45) Date of Patent: Nov. 11, 2008

(54) INK JET PRINTHEAD HAVING A MOVABLE REDUNDANT ARRAY OF NOZZLES

(75) Inventor: Roger A Newell, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 75 days.

(21) Appl. No.: 11/747,465

(22) Filed: May 11, 2007

(51) Int. Cl.
*B41J 29/393* (2006.01)

(52) U.S. Cl. ..... 347/19; 347/12; 347/15

(58) Field of Classification Search ..... 347/12, 347/15, 19, 43, 40; 358/1.2, 1.9
See application file for complete search history.

(56) References Cited

U.S. PATENT DOCUMENTS 3,946,398 A 3/1976 Kyser et al.
4,568,953 A 2/1986 Aoki et al.
4,789,425 A 12/1988 Drake et al.
4,829,324 A 5/1989 Drake et al.
5,124,720 A * 6/1992 Schantz ..... 347/19
5,192,959 A 3/1993 Drake et al.
5,221,397 A 6/1993 Nystrom
5,587,730 A * 12/1996 Karz ..... 347/43
6,174,039 B1 * 1/2001 Miyake et al. ..... 347/12

* cited by examiner

*Primary Examiner*—Lamson D Nguyen
(74) *Attorney, Agent, or Firm*—Lloyd F. Bean, II

(57) ABSTRACT

There is provided a printhead for an ink jet printer, including a primary and a secondary array of nozzles in the printhead, the nozzles in the primary array of nozzles being in alignment with the nozzles in the secondary array of nozzles in a printing process direction; detection system for detecting defective nozzles in both the primary array of nozzles and in the secondary array of nozzles; a first mode operation having means for selectively activating nozzles in the secondary array of nozzles that are in alignment with defective nozzles in the primary array of nozzles; and a second mode of operation having means, responsive to the detecting means, for translating the secondary array of nozzles in relation to the primary array of nozzles along a path to a first position to realigned the nozzles in the primary array of nozzles to nozzles in the secondary array of nozzles if defective nozzles are aligned in both the primary and the secondary array of nozzles.

9 Claims, 4 Drawing Sheets

INK JET PRINTHEAD HAVING A MOVABLE REDUNDANT ARRAY OF NOZZLES

BACKGROUND AND SUMMARY

An exemplary embodiment of this application relates to an ink jet printer having a printhead and controller that enables high-quality printing. More particularly, the exemplary embodiment relates to an ink jet printer with a set of two printhead arrays in which the second array of nozzles is movable with respect to a first array of nozzles in a cross process direction with the individual nozzles in one array being positioned in alignment or close to alignment with corresponding nozzles in the second array in the scanning or process direction.

Droplet-on-demand ink jet printing systems eject ink droplets from printhead nozzles in response to pressure pulses generated within the printhead by either piezoelectric devices or thermal transducers, such as resistors. The ejected ink droplets are propelled to specific locations on a recording medium, commonly referred to as pixels, where each ink droplet forms a spot on the recording medium. The printheads contain ink in a plurality of channels, usually one channel for each nozzle, which interconnect an ink reservoir in the printhead with the nozzles.

In a thermal ink jet printing system, for which the exemplary embodiment of this application is an example, the pressure pulse is produced by applying an electrical current pulse to a resistor typically associated with each one of the channels. Each resistor is individually addressable to heat and momentarily vaporize the ink in contact therewith. As a voltage pulse is applied across a selected resistor, a temporary vapor bubble grows and collapses in the associated channel, thereby displacing a quantity of ink from the channel so that it bulges through the channel nozzle. The ink bulging through the nozzle is ejected from the nozzle as a droplet during the bubble collapse on the resistor. The ejected droplet is then propelled to a recording medium. When the ink droplet hits the targeted pixel on the recording medium, the ink droplet forms a spot thereon. The channel from which the ink droplet was ejected is then refilled by capillary action, which, in turn, draws ink from an ink supply container.

In a typical piezoelectric ink jet printing system, the pressure pulses that eject ink droplets are produced by applying an electric pulse to the piezoelectric devices, one of which is typically located within each one of the ink channels. Each piezoelectric device is individually addressable to cause it to bend or deform and pressurize the volume of ink in contact therewith. As a voltage pulse is applied to a selected piezoelectric device, a quantity of ink is displaced from the ink channel and a droplet of ink is mechanically ejected from the nozzle associated with each piezoelectric device. Just as in thermal ink jet printing, the ejected droplet is propelled to a pixel target on a recording medium. The channel from which the ink droplet was ejected is refilled by capillary action from an ink supply. For an example of a piezoelectric ink jet printer, refer to U.S. Pat. No. 3,946,398.

A thermal ink jet printhead can include one or more printhead die assemblies, each having a heater portion and a channel portion. The channel portion includes an array of ink channels that bring ink into contact with the bubble-generating resistors, which are correspondingly arranged on the heater portion. In addition, the heater portion may also have integrated addressing electronics and driver transistors. The array of channels in a single die assembly is not sufficient to cover the full width of a page of recording medium, such as, for example, a standard sheet of paper. Therefore, a printhead having only one die assembly is scanned across the page of recording medium while the recording medium is held stationary and then the recording medium is advanced between scans. Alternatively, multiple die assemblies may be butted together to produce a full width printhead, such as, for example, the printhead disclosed in U.S. Pat. No. 4,829,324 and U.S. Pat. No. 5,221,397.

The ink jet printhead may be incorporated into a carriage type printer or a full width array type printer. The carriage type printer may have a printhead having a single die assembly or several die assemblies abutted together for a partial width size printhead. Since both single die and multiple die, partial width printheads function substantially the same way in a carriage type printer, only the printer with a single die printhead will be discussed. The only difference, of course, is that the partial width size printhead will print a larger swath of information. The single die printhead, containing the ink channels and nozzles, can be sealingly attached to a disposable ink supply cartridge, and the combined printhead and cartridge assembly is replaceably attached to a carriage that is reciprocated to print one swath of information at a time, while the recording medium is held stationary. Each swath of information is equal to the height of the column of nozzles in the printhead. After a swath is printed, the recording medium is stepped a distance at most equal to the height of the printed swath, so that the next printed swath is contiguous or overlaps with the previously printed swath. This procedure is repeated until the entire image is printed.

In contrast, the page width printer includes a stationary printhead having a length sufficient to print across the width of sheet of recording medium. The recording medium is continually moved past the full width printhead in a direction substantially normal to the printhead length and at a constant or varying speed during the printing process. Another example of a full width array printer is described, for example, in U.S. Pat. No. 5,192,959.

Ink jet printing systems typically eject ink droplets based on information received from an information output device, such as, a personal computer. Typically, this received information is in the form of a raster, such as, for example, a full page bitmap or in the form of an image written in a page description language. The raster includes a series of scan lines comprising bits representing individual information elements or pixels. Each scan line contains information sufficient to eject a single line of ink droplets across the recording medium in a linear fashion from one nozzle. For example, ink jet printers can print bitmap information as received or can print an image written in the page description language once it is converted to a bitmap of pixel information.

A problem with ink jet print printers is random failures of ink jet print heads due to nozzle contamination which limits their usefulness in high quality production applications. In the single-pass systems needed for high-speed production systems even weak or miss-directed jets may result in visible image defects in the form of streaks. Since these failures are unpredictable by nature, some form of regular output monitoring is needed to ensure that occurrences are detected before large portions of a job are affected. Even with such monitoring, the productivity impacts of stopping the press to change or purge heads could be significant.

The use of ink jet systems for high quality production printing applications has been very limited. Current systems typically address either lower quality applications such as direct mail/transaction documents or utilize pixel interlacing schemes with lower throughput rates (e.g., flatbeds printing signage). Web cleaners and air flow techniques have been used to minimize the amount of paper dust that comes in contact with the printheads, but the random failures of ink jet printheads still remain.

SUMMARY

There is provided full width arrays for an ink jet printer, including a primary and a secondary array, the nozzles in said primary array being in alignment with the nozzles in said secondary array in a printing process direction; detection system for detecting defective pixels in the printed output; a means for selectively activating nozzles in said secondary array that are in alignment with defective nozzles in said primary array of nozzles; and a means, responsive to said detecting means, for translating said secondary array of nozzles in relation to said primary array of nozzles along a path to a first position to realign the nozzles in said primary array of nozzles to nozzles in said secondary array of nozzles if defective nozzles are aligned in both said primary and said secondary array of nozzles.

BRIEF DESCRIPTION OF THE DRAWINGS

An exemplary embodiment of this application will now be described, by way of example, with reference to the accompanying drawings, in which like reference numerals refer to like elements, and in which.

DETAILED DESCRIPTION

Figure 1:
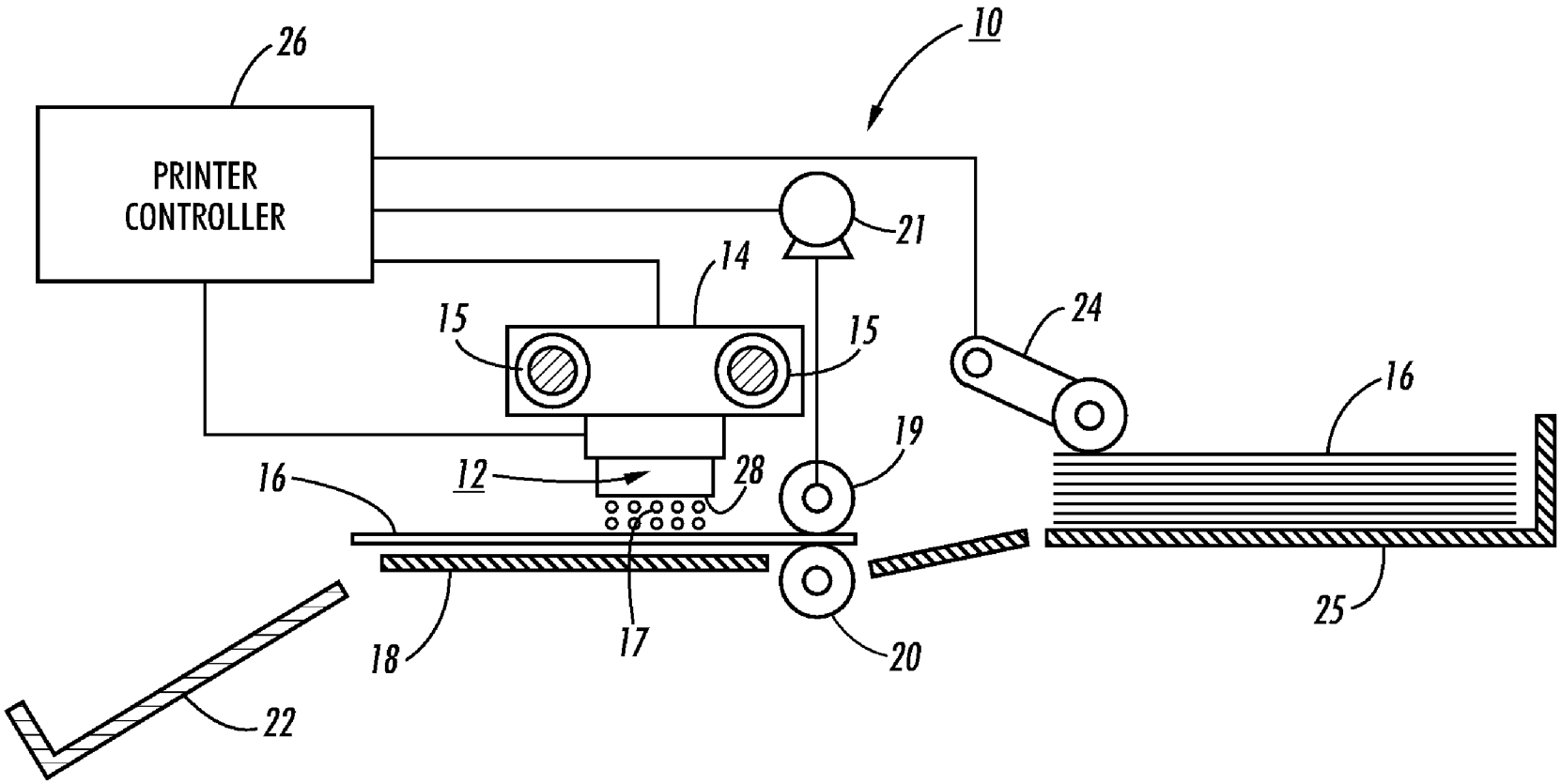
FIG. 1 is a schematic side elevation view of an ink jet printer having a type printhead usable with printing systems and methods according to the exemplary embodiment of this application.

In FIG. 1, a schematic representation of a carriage type thermal ink jet printer 10 is shown in a side elevation view. The ink jet printer 10 employs a translating thermal ink jet printhead 12 that has a roof shooter structure mounted on a carriage 14 which travels back and forth across the recording medium 16 on guide rails 15. In the orientation of the printhead shown in FIG. 1, the printhead translation is along guide rails that are normal to the surface of the drawing. Alternatively, the printer 10 may employ a fixed full width printhead (not shown) wherein the recording medium is continually moved there past at a constant or variable speed by feed rollers (not shown).

The printhead 12 ejects ink droplets 17 onto the recording medium 16 residing on printing platen 18 one swath at a time and feed rollers 19 and 20, one of which is driven by an electric motor 21, is capable of precise motion quality. The electric motor 21 is used both to register and step the recording medium 16 past the printhead 12 after each swath is printed until the entire surface area of the recording medium is printed or until all the information is printed, if less than a page. When the printing on the recording medium has been completed, the recording medium with the printed information is delivered to the catch tray 22. A typical document feeder 24 moves single sheets of recording medium 16 on demand from the printer controller 26 to the feed rollers 19, 20 from a cassette (not shown) or stack of recording medium 16 in supply tray 25. For a more detailed description of a printhead having a roof shooter structure refer to U.S. Pat. No. 4,568,953 and U.S. Pat. No. 4,789,425, the relevant portions of which are incorporated herein by reference. The printer controller 26 causes the timely delivery of a recording medium 16 to the printing platen 18 and the printhead 12 to print the information on it, as discussed later.

Figure 2:
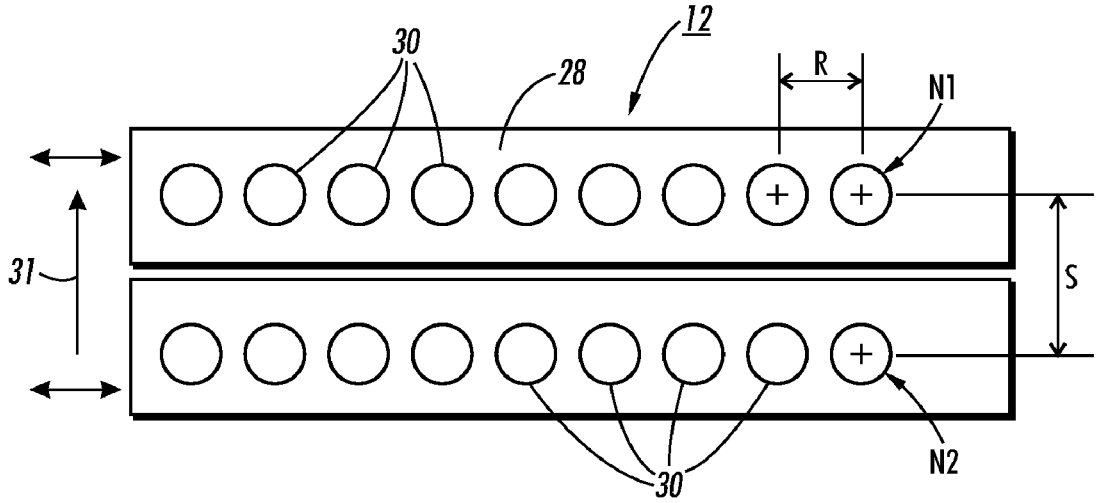
FIGS. 2 and 3 are a plan views of the two printhead having aligned linear arrays of nozzles using principles of the present disclosure.
Figure 3:
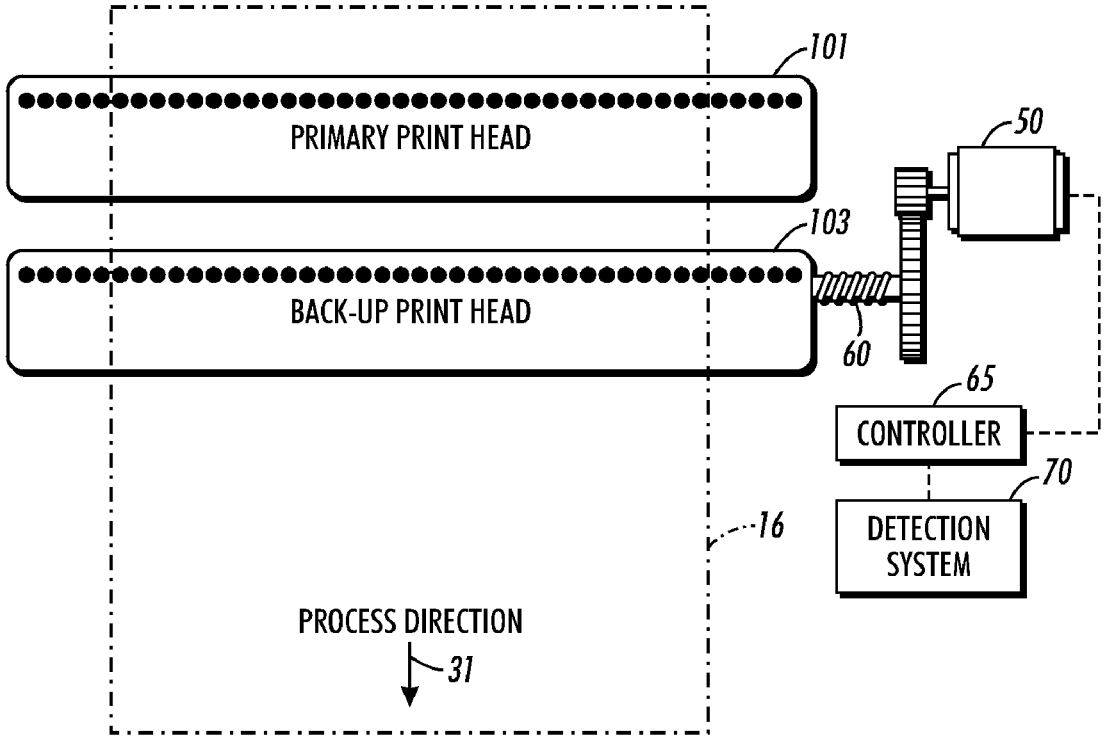

Now focusing on the present disclosure, a plan view of the nozzle face 28 of the printhead 12 is depicted in FIGS. 2 and 3, showing the two linear arrays of nozzles, a primary array of nozzles and a secondary array of nozzles being aligned in the printing process direction, as indicated by arrow 31. Primary linear array of nozzles is identified as N1, and the secondary linear array of nozzles is identified as N2.

Secondary linear array of nozzles N2 is movable in relation to primary linear array of nozzles N1 and can be re-positioned in the cross-process direction as needed by translation assembly 50 and 60 (as shown in FIG. 3) which is operably connected to secondary linear array of nozzles N2. The Translation assembly is capable of moving the secondary array N2 in small increments (i.e., on the order of the nozzle to nozzle spacing) with a positional accuracy consistent with that required for the initial setup of N2 in relation to N1 in the static embodiment. One implementation that has demonstrated this capability for ink jet printheads with greater than 100 nozzles per inch is a stepper motor/lead screw combination as depicted in FIG. 3.

The movable linear array of nozzles N2 is preferably slightly wider (e.g., 10% more nozzles) than the primary array N1 to increase the number of steps that can be taken while maintaining nozzle to nozzle coverage between the two. While this is not necessary, it will improve the expected benefit of the movable system over that achievable with identically sized arrays. Alternatively, the functional width of both arrays could be reduced in to achieve the same effect without actually building a separate, wider linear array of nozzles.

Detection system 70 monitors the printed image for weak, misdirected, or missing pixels and provides this information to the controller 65. The controller, in turn, identifies the corresponding nozzle position and determines what action to take. If the nozzle in the primary array N1 has not been flagged as failed, the controller does so at this time and activates the corresponding nozzle in the secondary or backup array N2. If the primary array nozzle has been flagged as failed, the controller initiates a translation move of array N2 based on its computation of the nearest acceptable position. (An acceptable position is one where there is no alignment of failed nozzles between the two arrays). Once the translation move has been accomplished, the backup nozzle in array N2 is activated and printing continues.

Preferably, detection system 70 employs a full width CCD array, the ability to detect weak or missing pixels at resolutions up to 600×600 dpi and process speeds in excess of 80 ips to inspect outputted sheets. Other implementations are also possible, including those monitoring nozzle functionality directly rather than the resultant marks on paper. The use of an automated detection system is not essential to the present disclosure. Manual inspection of the output, though less efficient means, could also be employed.

Figure 4:
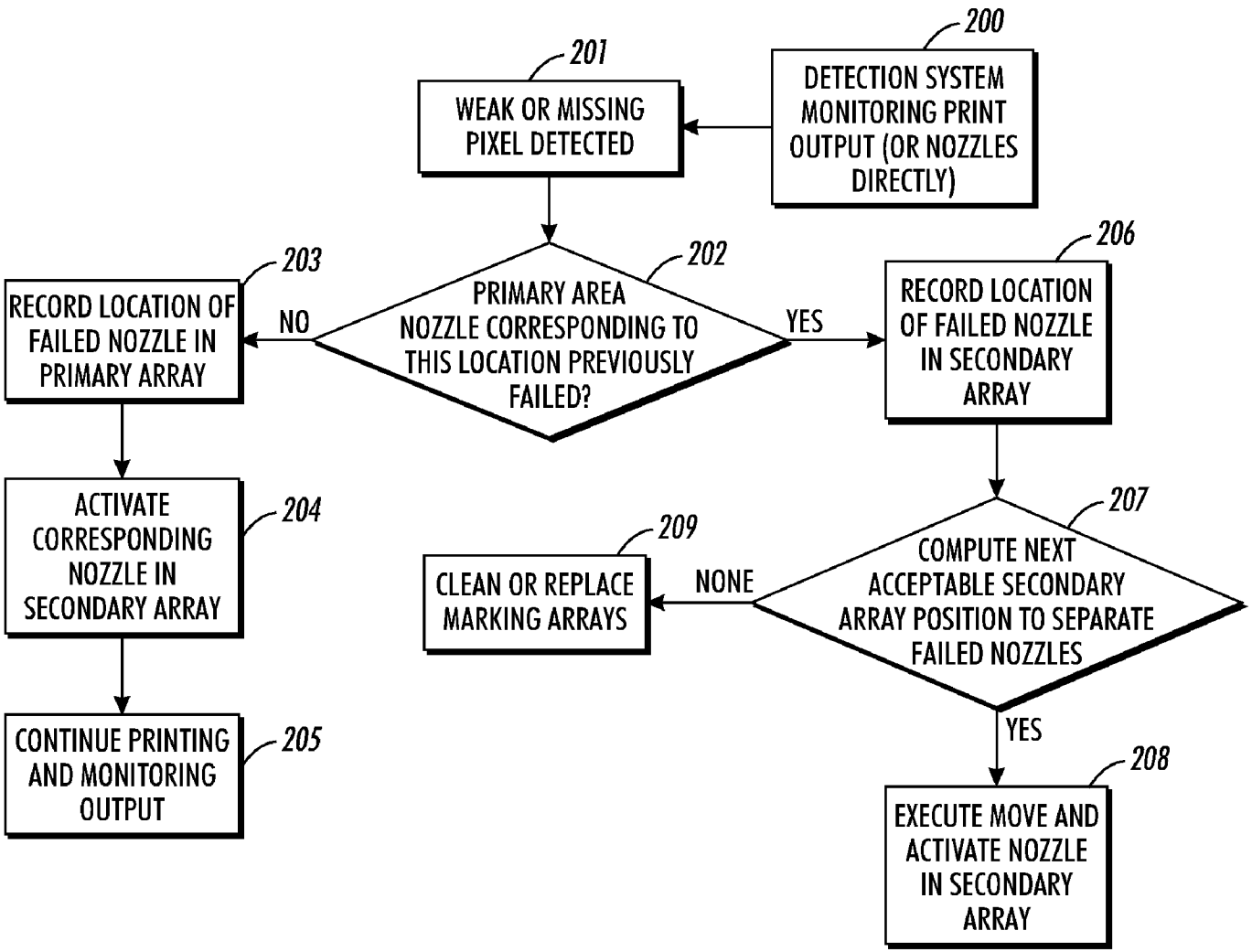
FIG. 4 is a process flow chart of the operation of printhead of the present disclosure.

Having in mind the construct and arrangement of the principle elements thereof, it is believed that a complete understanding of the present disclosure may now be had from a description of its operation and reference with the flow chart of FIG. 4.

The detection system (70) monitors the printed output for evidence of weak or missing marking digital elements (i.e., nozzles in ink jet systems). For ink jet systems, these failures are due primarily to dust particles/paper fibers obstructing the orifices and are random in nature. Periodically, printing a test pattern allows all nozzles to be monitored concurrently. The pattern itself can be printed in unused portions of the print media (e.g., between pages) or can usurp a full page of output, but should extend across the full print zone. Once a missing or weak pixel in the test pattern is detected (step 201), the information is fed to the controller which computes the nozzle position in the primary array (N1) corresponding to this pixel position. The controller then determines from memory if this nozzle has previously been flagged as failed (step 202). If not, it records the failure and turns-on the corresponding (in the cross-process direction) nozzle in the secondary array N2 and printing resumes (steps 203-205). If the nozzle in the primary array N1 has previously been flagged as failed, the controller determines an acceptable repositioning of secondary array N2 that minimizes the size (i.e., number of steps) of the move required (step 207). (Acceptable means that there are no instances of failed nozzles in the two arrays in alignment with one another across the entire print zone). Once this has been determined, the translation move itself is initiated and the digital element in the secondary array N2 is activated (step 208). Printing then resumes.

If no acceptable repositioning of the secondary array is possible (step 209), the controller informs the operator of the condition so that cleaning or replacement of one or both of the arrays can be initiated.

Figure 5:
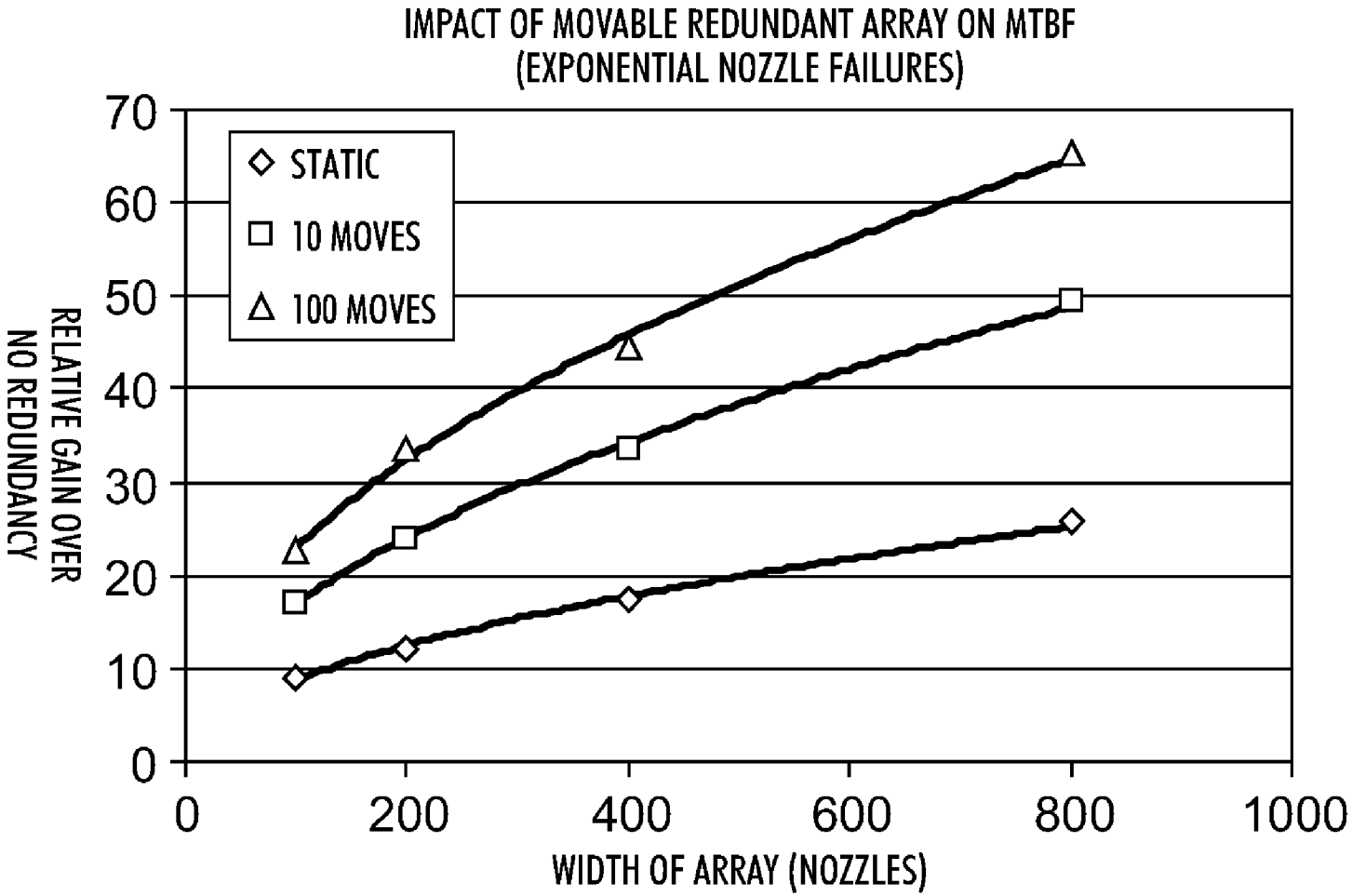
FIG. 5 illustrates the results of modeling a movable redundant system of the present disclosure compared to a stationary redundant system and a non-redundant system.

Advantageous feature of the present disclosure is that defective nozzle information (i.e. locations of defective nozzles) is stored in memory, preferably on a chip incorporated on to the array of nozzles. This allows for the life of the arrays to be extended further (if the defective nozzles cannot be cleared) by using either or both arrays (i.e., N1 and N2) in combination with different arrays (N3 and so on) so that the overlap of failed nozzles can be broken-up. For example, previously used arrays can be combined with currently used arrays to receive additional use FIG. 5 illustrates the results of modeling both a static and movable redundant system for purely random nozzle failures (results will vary but show the same relationship for a range of nozzle failure modes). The figure depicts the improvement in system life (MTBF) derived for both static redundancy and movable redundant systems compared to a non-redundant system. (System life is defined as the interval between maintenance actions such as cleaning or replacement of arrays.) Over the range of nozzles considered, static redundancy results in a system life gain of 10× to 25× over a non-redundant system. By allowing movement of the secondary or redundant array with respect to the primary array, the value derived by redundancy can be extended by an additional factor of 2.0-2.5×. As discussed previously, it is assumed the "functional width" of the movable array is slighter greater than that of the primary array (~10%).

This chart assumes that only the secondary array is movable. If both arrays are movable with respect to the print zone, an additional gain in system life of 20-25% can be obtained over these results.

Although the foregoing description illustrates the preferred embodiment, other variations are possible and all such variations as will be apparent to those skilled in the art intended to be included within the scope of this application as defined by the following claims.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A printhead for an ink jet printer, comprising:

a primary and a secondary array of nozzles in the printhead, the nozzles in said primary array of nozzles being in alignment with the nozzles in said secondary array of nozzles in a printing process direction;

means for detecting defective nozzles in both said primary array of nozzles and in said secondary array of nozzles;

means for selectively activating nozzles in said secondary array of nozzles that are in alignment with defective nozzles in said primary array of nozzles; and means, responsive to said detecting means, for translating said secondary array of nozzles in relation to said primary array of nozzles along a path to a first position to realigned the nozzles in said primary array of nozzles to nozzles in said secondary array of nozzles if defective nozzles are aligned in both said primary and said secondary array of nozzles.

2. The printhead as claimed in claim 1, wherein said secondary array of nozzles is substantially physically wider than said primary array of nozzles.

3. The printhead as claimed in claim 1, wherein said secondary array of nozzles is substantially functionally wider than said primary array of nozzles.

4. The printhead as claimed in claim 1, wherein said translating means translate said secondary array of nozzles in relation to said primary array of nozzles along said path to a second position, when said detecting means detects a defective nozzle in either said primary array of nozzles or secondary array of nozzles.

5. The printhead as claimed in claim 4, further comprising a controller, responsive to said translation means and said detection means; for aligning the nozzles in said primary array of nozzles to nozzles in said secondary array of nozzles.

6. The printhead as claimed in claim 5, further comprising means for storing locations of defective nozzles in either said primary array of nozzles or secondary array of nozzles.

7. The printhead as claimed in claim 1, further comprising a third array of nozzles replaceable with either said primary array of nozzles or said secondary array of nozzles.

8. The printhead as claimed in claim 7, wherein said third array of nozzles has defective nozzles.

9. The printhead as claimed in claim 1, wherein said printhead is a piezoelectric ink jet printhead having selectively addressable piezoelectric devices that selectively eject ink droplets when electric pulses are applied thereto.

* * * * *